US007314354B2

(12) United States Patent
Stroganov et al.

(10) Patent No.: US 7,314,354 B2
(45) Date of Patent: Jan. 1, 2008

(54) ROTOR MACHINE

(76) Inventors: Alexandr Anatoievich Stroganov, Street Stasovoi Home 2 Apartm. 479, S-Petersburg (RU) 195235; Yury Mikhailovich Volkov, Street Zvenigorodskaya Home 28 Apartm. 3, S-Petersburg (RU) 191119

( * ) Notice: Subject to any disclaimer, the term of this patent is extended or adjusted under 35 U.S.C. 154(b) by 434 days.

(21) Appl. No.: 10/512,208

(22) PCT Filed: May 20, 2003

(86) PCT No.: PCT/US03/00230

§ 371 (c)(1),
(2), (4) Date: Oct. 22, 2004

(87) PCT Pub. No.: WO03/100255

PCT Pub. Date: Dec. 4, 2003

(65) Prior Publication Data

US 2006/0153717 A1 Jul. 13, 2006

(30) Foreign Application Priority Data

May 28, 2002 (RU) ..... 2002114208

(51) Int. Cl.
*F04B 43/12* (2006.01)

(52) U.S. Cl. ..... 417/477.1; 418/219

(58) Field of Classification Search ..... 417/269, 417/477.1; 418/219, 228, 217, 229, 230
See application file for complete search history.

(56) References Cited

U.S. PATENT DOCUMENTS 3,993,417 A * 11/1976 Harrington ..... 418/137
5,429,084 A * 7/1995 Cherry et al. ..... 123/243

FOREIGN PATENT DOCUMENTS

| | | | |
|---|---|---|---|
| EP | 1126175 | A1 * | 8/2001 |
| GB | 2207953 | A | 2/1989 |
| RU | 2123602 | C1 | 12/1998 |
| RU | 2175731 | C1 | 11/2001 |
| WO | WO 88/02438 | A | 4/1988 |

* cited by examiner

*Primary Examiner*—Anthony D. Stashick
*Assistant Examiner*—Leonard J Weinstein
(74) *Attorney, Agent, or Firm*—Christopher L. Parmelee; Walker & Jocke LPA

(57) ABSTRACT

The invention can be used for reversible pulsationless rotor high-pressure machines which can operate in pump and in motor mode. The inventive machine comprises a working chamber and an additional working chamber, separating jumpers and regulating elements. Said regulating elements are connected to each other with the aid of a kinematic link in such a way that the motion of one regulating element initiates the motion of another regulating element. Working cavity of said working chambers are arranged in an axial direction oppositely to each other and connected to each other by means of channels. A mechanism setting an axial relative position of displacers is embodied in such a way that it always provides a sliding contact of at least one displacer with each regulating element. Said invention makes it possible to extent the functional capabilities of similar rotor machines and improve the operational parameters thereof.

6 Claims, 6 Drawing Sheets

ROTOR MACHINE

This invention relates to mechanical engineering and may be used in high-pressure low pulsation reversible machines, able to operate both as a motor and a pump. Gaseous and liquid working fluids are applicable.

In known adjustable rotary machine (UK 2207953), the rotor is mounted within the housing containing inlet and outlet openings. The rotor has the slots containing radially sliding valves. The pump comprises of a mechanism for positioning the valves in the rotor slots, a working chamber, and a regulating member movable in radial direction.

Taken as the closest prior-art a high-pressure low pulsations reversible adjustable pump (RU 2123602) comprises housing with inlet and outlet openings, and a rotor mounted inside the housing. The rotor has the slots for the valves which are able to reciprocate along the rotor rotation axis. (Further, instead of the term "valve" the more common one "displacer" will be used). The pump comprises mechanism mounted in the housing providing for axial positioning of the displacers in the rotor slots, a working chamber, and a partition which, together with the rotor, separates the suction and pumping spaces, thus preventing back flow of the working fluid between them. This partition is actually the one of the insulating members preventing back flow of the working fluid between the pump cavities, and a special case of one of the partitions, since any pump of this design has at least two partitions.

In this pump the working chamber is bounded in axial direction on one side by the surface of the rotor flank which has a sliding contact with the partition and is called the first flank of the rotor and on the other side by the regulating member which actually is a movable insulating member namely the second partition mounted opposite to the first flank of the rotor and moving axially.

Rotor pumps of this design always have two distinguishable groups of members, which simultaneously rotate relative to one another with equal values of the angular velocity and in opposite directions around their common axis. Usually they distinguish one by one basic member in each group and these two members rotating relatively to one another cause rotation of the rest of the pump elements. One of these basic members is usually called the rotor and the other one relative to which the rotation is viewed is called the stator (or also often it is called the housing).

The terms "rotor member" and "stator member" (hereinafter "rotor" and "stator") are relative and depend only on which member is viewed as rotating relative to the other one. It should be noted that all rotations are viewed (unless something else is mentioned) relative to the common axis of rotation and the axial direction means that one is parallel to this common axis of rotation.

When the rotor starts to rotate relative to the stator, the assembly of the pump members kinematically tied to the rotor starts rotating as well. The combination of these members and the rotor itself will hereinafter be called the rotor unit. The rest of the pump members which do not rotate together with the rotor relative to the stator and the stator itself will hereinafter be called the stator unit. I's always possible to distinguish the assembly of parts forming the pump working chamber in the rotor unit and the stator unit. The working chamber comprises of a suction space and a pumping space, and the members which are the working parts of the pump that directly do the work of delivering the working fluid from the suction space to the pumping space can also be distinguished in the rotor unit and the stator unit. The suction and pumping spaces are the working spaces of a pump (which are connected correspondingly to the inlet and outlet ports). In the aforementioned pumps when the rotor unit and the stator unit do one revolution of their mutual rotation the working parts of these units do rotational movements as well, together with the above mentioned units, besides the working parts of one of these units also do the cyclic movements along their common axis of rotation per every revolution of this unit and together with the working parts of the second unit (other unit) which do not do such cyclic movements.

The pump unit in which the members that are the working parts do also the cyclic movements along the common axis of rotation per every revolution of the rotor will hereinafter be called the rotor unit and accordingly, the basic member of it will be called the rotor. The rest of the unit will hereinafter be called the stator unit and accordingly the basic member of it will be called the stator.

It should be noted that rotation of the rotor will be always viewed relative to the stator, no matter what device the stator is mounted on to provide rotation of the rotor relative to the stator.

In many practical cases of the present invention usage, the pump member called the stator may be mounted on a rotating shaft of a certain device, whereas the pump member called the rotor may be mounted on a frame or another rotating shaft of the same device. Hereinafter all rotations of the rotor will be viewed relative to the stator in accordance with the above mentioned meanings of these terms. The working parts which rotate with the rotor and directly do the work of delivering the working fluid to the pumping space of the pump are usually called displacers (hereinafter we will use this term), and the members of the stator unit which together with the members of the rotor unit which separate the suction space from the pumping space are called partitions (hereinafter we will use this term). In adjustable types of pumps one of the partitions is usually mounted so that it can move relative to the rotor and is called the regulating member. The suction space is connected to the inlet port and the pumping space is connected to the outlet port. The pumps with one cycle of the displacers' movement per one revolution of the rotor always have at least two partitions which separate the suction space from the pumping space. Two cycle pumps have twice the number of partitions, three cycle pumps have three times the number of partitions, etc.

The difference between the distances from the rotor to the flanks of the partitions faced to the rotor determines the delivery per one rotor revolution for this type of pump (in other words the axial distance between the flanks of the partitions faced to the rotor determines the delivery per one rotor revolution for these pumps).

When chosen as the prior-art rotary machine operates as a pump it is not possible to reverse the direction of working fluid delivery without reversing the rotor rotation direction. When it operates as a hydraulic motor it is also not allowing reversing the rotor rotation direction without reversing the direction of working fluid delivery.

BRIEF SUMMARY OF THE INVENTION

The object of the present invention is to widen the range of functionality for such rotary machines and to improve their operating parameters.

This problem has been solved by the design of the rotary machine which comprises the combination of the members of a stator unit and a rotor unit, namely it has a stator, a rotor with slots in which the displacers capable of moving along the axis of the rotor rotation are located, a mechanism for setting the axial mutual disposition of the displacers, a working chamber bounded in axial direction by the first flank of the rotor and including a suction space and a pumping space, a partition mounted on the stator opposite the first flank of the rotor and a regulating member mounted on the stator opposite the first flank of the rotor (in the same place) movable axially; accordingly to the present invention the rotary machine has an additional working chamber bounded axially by the second flank of the rotor and comprising of its own suction space and pumping space (the flanks of the displacers extend to these spaces), a partition and a regulating member mounted both on the stator opposite the second flank of the rotor, the regulating member is mounted so that it can move axially, besides the regulating member is positioned so that its flank perpendicular to the axis of the rotor rotation is located opposite to the perpendicular to the axis of the rotor rotation flank of the partition, which is mounted on the stator opposite the first flank of the rotor and the partition mounted opposite the second flank of the rotor is mounted so that its flank perpendicular to the rotor rotation axis is located opposite the perpendicular to the rotor rotation axis flank of the regulating member which is mounted on the stator opposite the first flank of the rotor and the regulating members are tied to one another via a rigid kinematic joint so that the movement of one regulating member causes the other regulating member to move, moreover the working spaces of both working chambers located axially opposite one another are connected between themselves by the channel and a mechanism for setting the axial mutual position of the displacers is designed so that it insures sliding contact of each regulating member with at least one displacer.

Introducing the above mentioned features to the rotary machine makes it possible to reverse the direction of working fluid delivery without reversing the rotor rotation direction and without using any special switch apparatuses when the machine operates as a pump. When it operates as a hydraulic motor it is possible to reverse the rotor rotation direction without reversing the direction of working fluid delivery.

Moreover the effort required to apply the regulating members to control the rotor machine does not depend any more on the working pressure in the system and the variations of the pressure in the system caused by irregular load of the pump do not transmit through the working fluid to the mechanism of the displacers axial positioning and to the delivery regulating unit. This allows to depart from a hydraulic actuator in the regulating unit and to decrease the control time of the rotary machine. Such mutual positioning of the regulating members and the partitions allows for this type of the rotary machines to reverse the direction of working fluid delivery by using just one set of displacers, one mechanism for setting their axial mutual position and to have the rotor completely balanced from the working fluid pressure forces acting on the rotor flanks.

Besides that in the particular embodiment of a rotary machine in order to unload the rotor from radial pressure forces of the working fluid, and to diminish radial vibrations of the rotor and the noise caused by them as well as to diminish the fluid friction on the walls bounding the working chamber radially both working chambers may be bounded radially by the surfaces of the annular grooves provided in the opposite flanks of the rotor so that they pass through the channels in the rotor, wherein the displacers are located and the said channels form recesses in the inner surfaces of the annular grooves by intersecting them.

In other words the annular grooves are disposed at the rotor flanks so that they pass through the rotor bores wherein the displacers are located and the radial width of the annular cylindrical grooves is less than the width of the displacers. The bottom of the first annular groove is actually the first flank of the rotor and the bottom of the second groove is the second flank of the rotor.

The combination of all the above mentioned features introduced into a rotor machine widens its functionality, namely: it allows to reverse the direction of working fluid delivery with invariable direction of the rotor rotation when this rotary machine operates as a pump; to reverse the direction of the rotor rotation under fixed direction of the working fluid delivery when this rotary machine operates as a hydraulic motor; to increase the control speed, to get a constant regulating effort independently of the working pressure in the system, to simplify the design, and to increase essentially the resistance with respect to abrupt pressure jumps in the system which the machine is connected to.

In common with the other types of rotary machines this machine may have a multi-chamber design with several working cycles of the displacers per one rotor revolution.

The essence of the present invention is clarified by the drawings which represent:

DETAILED DESCRIPTION OF THE INVENTION

Figure 1:
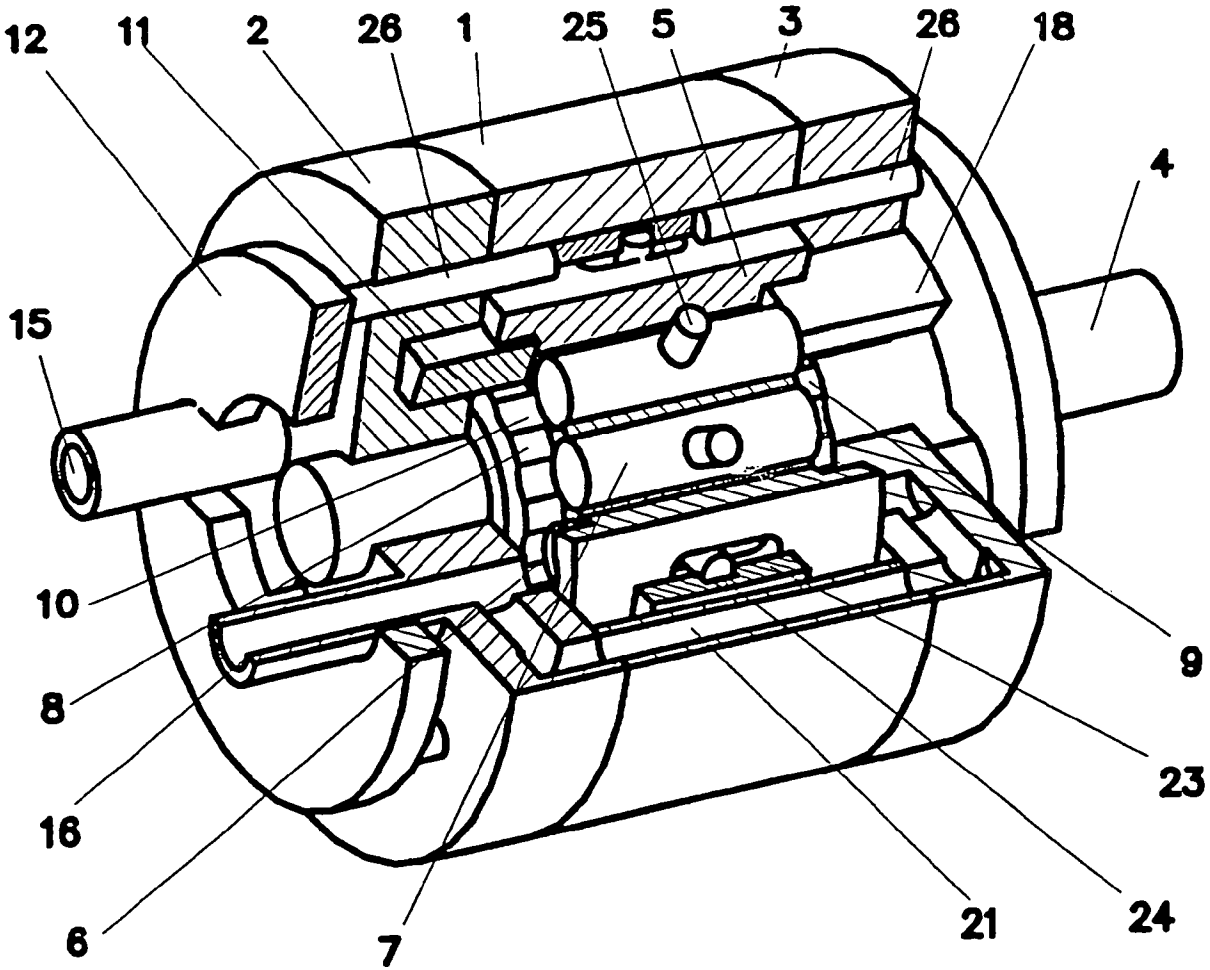
FIG. 1 is a rotary machine with three quarters of the housing and the rotor omitted.

The rotary machine of the present invention embodiment (FIG. 1) comprises of housing (stator) 1 with end closures 2 and 3. Rotor 5 is mounted on shaft 4 within housing 1. Bores 6 are made through rotor 5 wherein axially movable displacers 7 are located.

The flank of rotor 5 which is opposite end closure 2 and called the first flank of rotor 5 has annular groove 8 passed through bores 6. Also the flank of rotor 5 opposite end closure 3 has a similar annular groove 9 which is made so that it passes through bores 6 as well. The annular grooves 8 and 9 are made so that bores 6 form recesses 10 in their inner cylindrical surfaces. The rotor machine comprises partition 11 mounted on end closure 2 opposite the first flank of rotor 5 and axially movable regulating member 12 mounted on the same end closure 2 opposite the same flank of rotor 5. The flank of partition 11 is in sliding contact with the bottom of annular groove 8.

Figure 2:
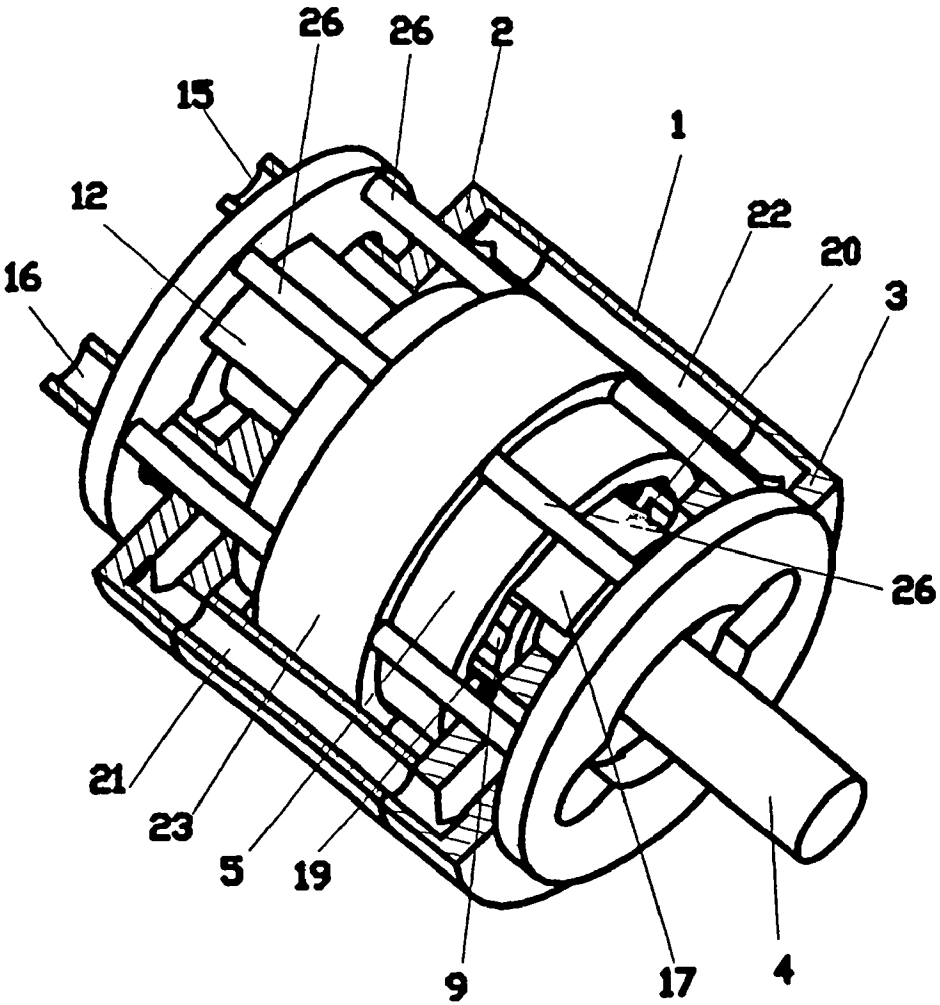
FIG. 2 is a section of the rotary machine taken through the plane of the channels of the housing.
Figure 3:
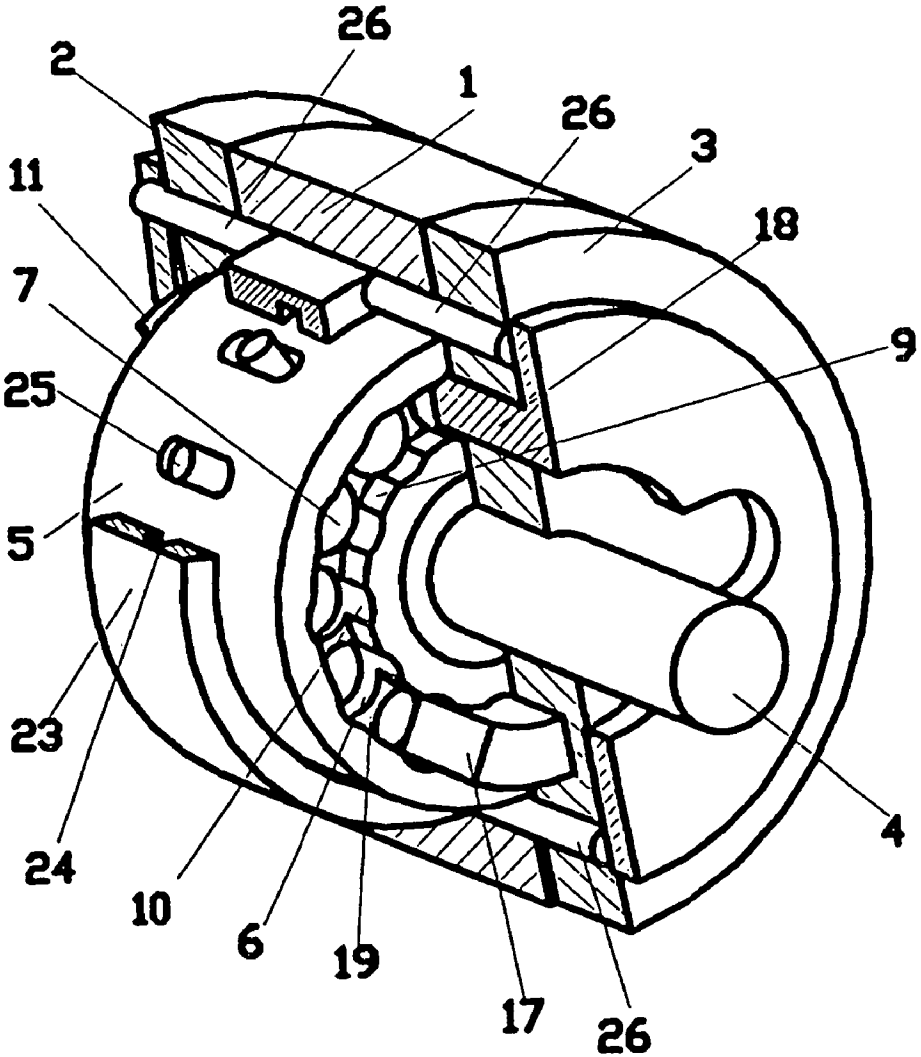
FIG. 3 is a section of the rotary machine; shaft-side view.
Figure 4:
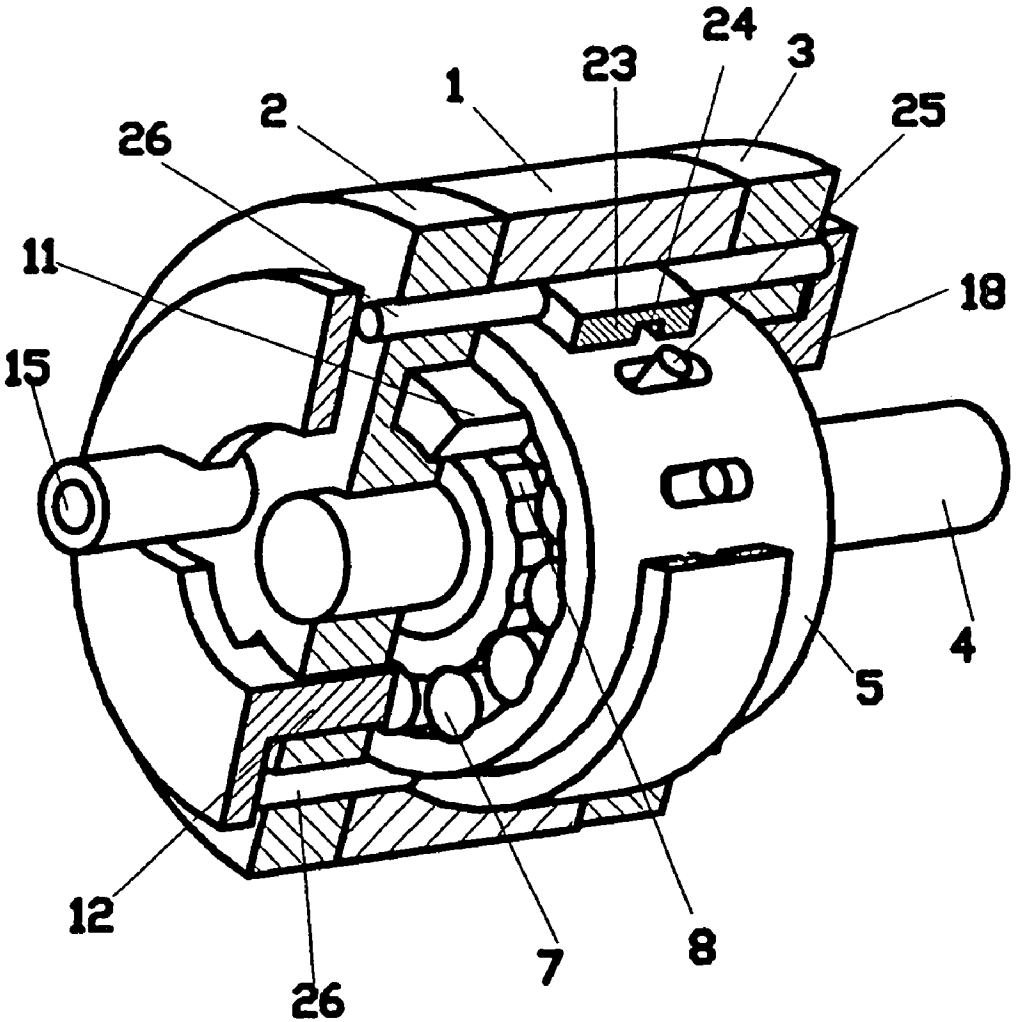
FIG. 4 is a section of the rotary machine; view in the direction of the inlet and outlet ports.
Figure 5:
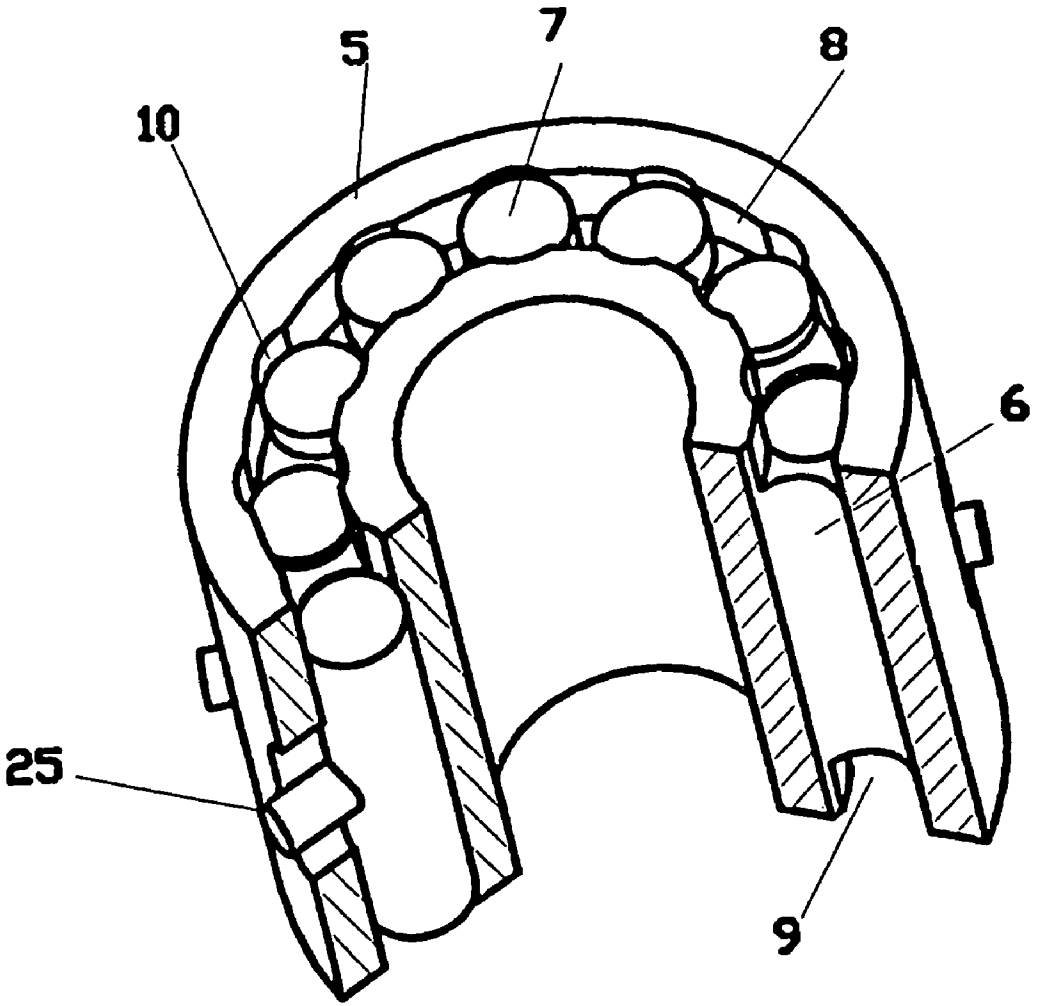
FIG. 5 is a rotor with displacers.
Figure 6:
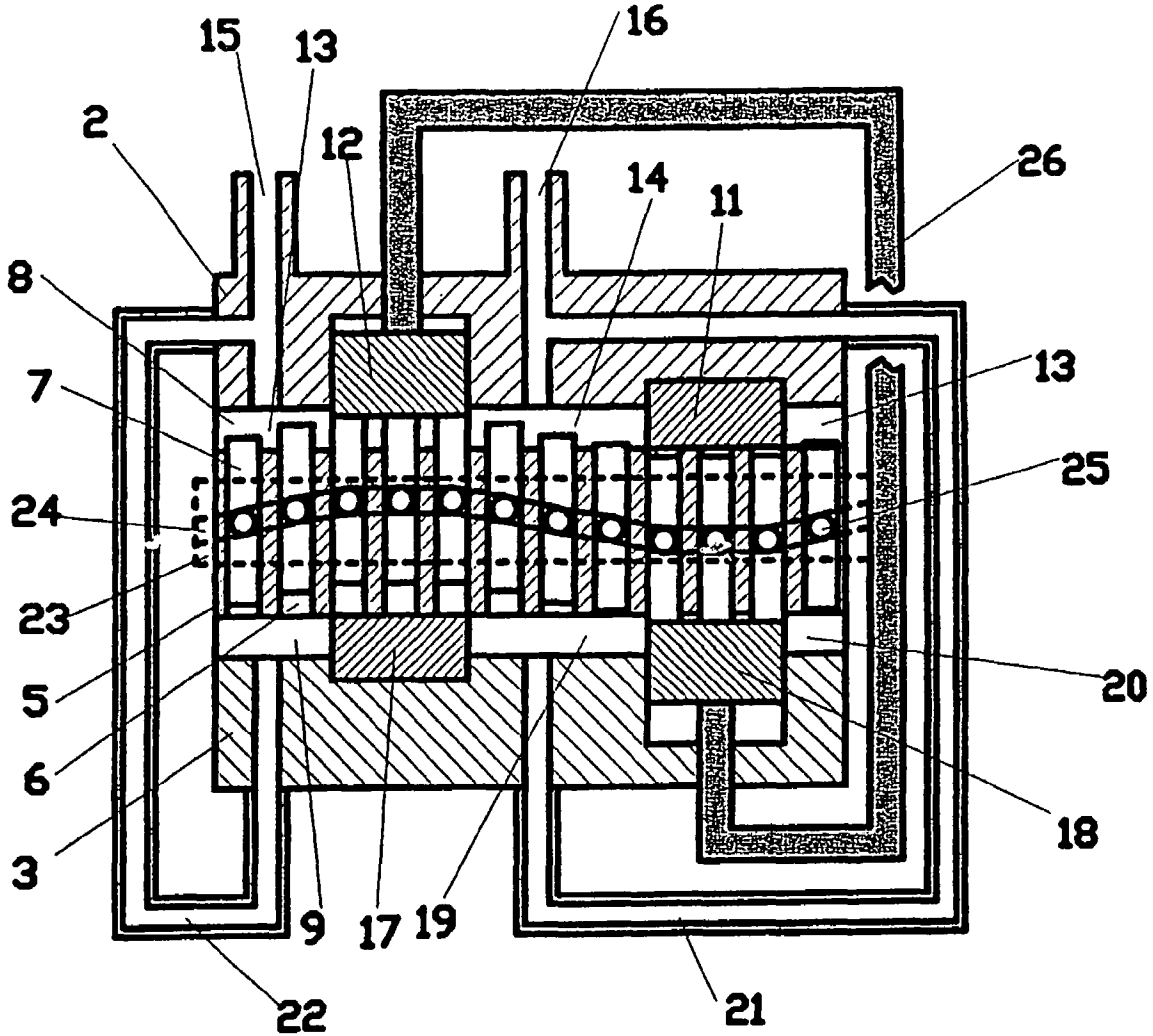
FIG. 6 is an unfolded side view from the center of the working chamber.

This annular groove 8 together with end closure 2 bounds the first working chamber. Partition 11 and regulating member 12 divide this working chamber into suction space 13 and pumping space 14 (FIG. 6). Suction space 13 is connected to inlet port 15 and pumping space 14 is connected correspondingly to outlet port 16. The said rotary machine has partition 17 (FIG. 2) mounted on end closure 3 opposite the second flank of rotor 5 and axially movable regulating member 18 mounted on the same end closure 3 opposite the same flank of rotor 5. The flank of partition 17 is in sliding contact with the bottom of annular groove 9. This annular groove 9 together with end closure 3 bounds the additional working chamber. Partition 17 and regulating member 18 divide the additional working chamber into suction space 19 and pumping space 20 (FIG. 2). Partition 17 is mounted so that its flank facing the second flank of rotor 5 is located opposite the flank of regulating member 12 mounted opposite the first flank of rotor 5. And regulating member 18 is mounted so that its flank facing the second flank of rotor 5 is located opposite the flank of partition 11 which is opposite the first flank of rotor 5. Suction space 19 (FIG. 2) of the additional working chamber is connected via channel 21 to pumping space 14 (FIG. 6) of the first working chamber and pumping space 20 (FIG. 2) is connected via channel 22 to suction space 13 (FIG. 6). These slots pass through housing 1 but in the general embodiment of the present invention they can be made in the rotor and in the displacers but it is important that the slots connect the opposite chambers of the rotary machine.

The rotary machine comprises the mechanism positioning the displacers 7 axially which is made so, that it ensures sliding contact between at least one of the displacers and each of regulating members 12 and 18. The mechanism for positioning the displacers axially is made by a hollow cylinder surrounding rotor 5 and mounted so that it can move axially. On the inner surface of this hollow cylinder closed curved groove 24 is made so that its curvature defines the axial mutual position of displacers 7. Besides that each displacer 7 is supplied with follower 25. These followers 25 enter closed curved groove 24. Closed curved groove 24 is made so that at least one of displacers 7 disposed opposite the flank of regulating member 12 is in contact with the flank of the regulating member 12 and at least one of displacers 7 disposed opposite the flank of regulating member 18 is in contact with the flank of regulating member 18.

Moreover regulating members 12 and 18 and hollow cylinder 23 are tied via pull stud 26 so that the axial movement of pull stud 26 causes similar movement of regulating members 12 and 18 as well as hollow cylinder 23.

The rotary machine used as a pump functions the following way.

At start pull stud 26 is positioned so that regulating member 12 and regulating member 18 are disposed at equal distances from the flanks of rotor 5 which they are opposite and hollow cylinder 23 is also at the midposition. For this purpose pull stud 26 is tied to them as required.

When rotor 5 starts to rotate followers 25 of displacers 7 begin to slide over the surfaces of closed curved groove 24 and displacers 7 begin to reciprocate along the axis of the rotor rotation. Closed curved groove 24 is made so that the movement of each displacer 7 per one revolution of rotor 5 is characterized by the following cycle: displacer 7 having at the start point sliding contact with the flank of regulating member 12 begins to slide over its flank towards partition 11 separating at the same time suction space 13 from pumping space 14 in the first working chamber. With further rotation of rotor 5 at a certain moment displacer 7 starts to go into rotor 5 and stops separating suction space 13 from pumping space 14 i.e. loosing its sliding contact with regulating member 12.

But displacer 7 which is next to it at the same time slides over the flank of regulating member 9 separating suction space 13 from pumping space 14. The working fluid confined between two neighboring displacers 7 and also inside slots 6 wherein these displacers 7 are located, starts moving from suction space 13 to pumping space 14 which displacers 7 come to when rotor 5 rotates.

With further rotation of rotor 5, displacer 7 passes over partition 11 and again begins to come to regulating member 12. Then at some moment displacer 7 again touches the flank of regulating member 12 with its own flank and begins to slide over this flank separating suction space 13 from pumping space 14 as at the start moment.

The work cycle in the additional working chamber is almost the same, with the only difference being that displacer 7 which is in sliding contact with regulating member 12 passes over partition 17 at the same moment and then when displacer 7 passes over partition 11 it is a sliding contact with regulating member 18 separating suction space 19 from pumping space 20. Suction space 19 of the additional working chamber at the same time is opposite pumping space 14 of the first working chamber and pumping space 20 is correspondingly opposite suction space 13. Since suction space 19 is connected via channel 21 to pumping space 14 and pumping space 20 is connected via channel 22 to suction space 13 and regulating members 12 and 18 are at the midposition there is no working fluid flow through inlet port 12 and outlet port 16. This occurs because the amount of working fluid going into pumping space 14 is equal to the amount of working fluid going out off suction space 19 (these spaces are connected via channel 21) and the amount of working fluid going out of suction space 13 is equal to the amount of working fluid going into pumping space 20 (these spaces are connected via channel 22).

When regulating member 12 is shifted by pull stud 26 to the end of its range from rotor 5, hollow cylinder 23 and regulating member 18 also move in the same direction. Displacers 7 being in sliding contact with the flank of regulating member 12 slide out from rotor 5 to the same axial extent as regulating member 12 and displacers 7 being in sliding contact with the flank of regulating member 18 correspondingly slide into rotor 5.

The working fluid delivery to pumping space 14 from suction space 13 increases and the intake of working fluid from suction space 19 and its flow to pumping space 20 decreases, therefore the working fluid starts pumping into outlet port 16 and flowing out of inlet port 15. In order to reverse the direction of the working fluid flow in the rotary machine pull stud 26 must be shifted to the other extreme position where regulating member 18 is furthermost from rotor 5. When regulating member 18 is in this position the direction of the working fluid flow is reversed and the working fluid starts pumping now into port 15 and flowing out of port 16.

It should be noted that when regulating members 12 and 18 are in these extreme positions the rotary machine works with maximum delivery and different directions of the working fluid pumping. When regulating members 12 and 18 approach the midposition, delivery of the rotary machine reduces to zero and begins to increase again when regulating members 12 and 18 pass over the midposition but at the same time the direction of working fluid pumping reverses.

Since the working chambers located in the same axial direction opposite each other are connected to each other via the channels the working pressures in them are equal and the pressure forces acting on rotor 5 from these working chambers are completely balanced. When the rotary machine operates as a hydraulic motor it is possible to change both speed and direction of rotor 5 rotation by the positioning of pull stud 26 similar to other reversible rotary machines.

The invention claimed is:

1. A rotary machine which comprises:

a stator, a rotor with a plurality of channels wherein a plurality of axially movable displacers are located, a mechanism for setting an axial mutual position of the displacers, a working chamber bounded in axial direction by a first flank of the rotor and comprising a suction space and a pumping space connected correspondingly to an inlet port and an outlet port, a partition mounted on the stator opposite the first flank of the rotor, an axially movable regulating member mounted on the stator opposite the first flank of the rotor, an additional working chamber bounded in axial direction by a second flank of the rotor and including its own working suction space and pumping space, a partition and an axially movable regulating member both mounted on the stator opposite the second flank of the rotor, which regulating member is mounted so that its flank perpendicular to the rotor axis, is located opposite the perpendicular to the rotor axis flank of the partition which is mounted on the stator opposite the first flank of the rotor, wherein the partition mounted opposite the second flank of the rotor is mounted so that its flank perpendicular to the rotor axis is located opposite the perpendicular to the rotor axis flank of the regulating member mounted on the stator opposite the first flank of the rotor, wherein the regulating members are kinematically tied so that movement of one regulating member causes the other regulating member to move, wherein the working spaces of both the working chambers located in axial direction opposite one another are connected to each other by channels, and wherein the mechanism for setting an axial mutual position of the displacers is made so that it insures sliding contact of each regulating member with at least one displacer.

2. The rotary machine according to claim 1 wherein both working chambers are radially bounded by surfaces of annular grooves provided in the opposite flanks of the rotor and passing through the channels in the rotor where the displacers are located, wherein the channels where the displacers are located form recesses in the surfaces of the annular grooves by intersecting the annular grooves.

3. The rotary machine according to claim 1, wherein the partition and the axially movable regulating member for each respective working chamber divide the suction space and pumping space in each respective working chamber.

4. The rotary machine according to claim 1, wherein the rotor includes a rotational axis, about which the rotor rotates with respect to the stator, wherein the axially movable regulating members opposite each respective flank of the rotor are operative to move with respect to the rotor in directions parallel to the rotational axis of the rotor.

5. The rotary machine according to claim 1, wherein the channels connecting working spaces opposite each other in the axial direction provide fluid pathways between the working chambers.

6. The rotary machine according to claim 1, wherein the channels connecting working spaces opposite each other in the axial direction extend through at least one wall of the stator.

* * * * *